US006350047B1

(12) United States Patent
Ng et al.

(10) Patent No.: US 6,350,047 B1
(45) Date of Patent: Feb. 26, 2002

(54) RECESSED DOWNLIGHT WALL WASH REFLECTOR ASSEMBLY AND METHOD

(75) Inventors: Sherman Ng, South Dartmouth, MA (US); Wayne Rogers, Tiverton, RI (US); Brian Roberge, Allston, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/567,490

(22) Filed: May 8, 2000

(51) Int. Cl.[7] ..... F21V 17/02; F21V 21/04

(52) U.S. Cl. ..... 362/364; 362/148; 362/282; 362/297; 362/322; 362/345; 362/346

(58) Field of Search ..... 362/147, 148, 362/280–283, 297, 304, 306, 322, 323, 346, 364, 365, 345, 373

(56) References Cited

U.S. PATENT DOCUMENTS

| | | | | |
|---|---|---|---|---|
| 3,518,420 A | | 6/1970 | Kripp | 362/365 |
| 4,177,504 A | * | 12/1979 | Henderson, Jr. et al. | 362/282 |
| 4,313,154 A | | 1/1982 | Capostagno et al. | 362/365 |
| 4,327,403 A | | 4/1982 | Capostagno et al. | 362/306 |
| 4,475,147 A | | 10/1984 | Kristofek | 362/148 |
| 4,551,791 A | * | 11/1985 | Salansky | 362/365 |
| 4,712,168 A | | 12/1987 | Scherrer | 362/427 |
| 4,742,440 A | * | 5/1988 | Guzzini | 362/346 |
| 4,930,054 A | * | 5/1990 | Krebs | 362/373 |
| 5,031,084 A | | 7/1991 | Russo et al. | 362/365 |
| 5,662,413 A | | 9/1997 | Akiyama | 362/365 |
| 5,673,997 A | | 10/1997 | Akiyama | 362/147 |
| 5,800,050 A | | 9/1998 | Leadford | 362/296 |
| 5,857,766 A | | 1/1999 | Sieczkowski | 362/365 |
| RE36,908 E | * | 10/2000 | Ling | 362/297 |

* cited by examiner

*Primary Examiner*—Alan Cariaso
(74) *Attorney, Agent, or Firm*—Charles G. Lamb; Jeffrey A. Haeberlin; Middleton Reutlinger

(57) ABSTRACT

A recessed downlight wall wash reflector assembly and method of installing the same. The reflector assembly is installable from below the plane of a ceiling into a standard mounting frame for a recessed downlight reflector having a similarly sized light exit aperture. In the preferred embodiment configured for use as a single wall washer, the reflector assembly has a downlight reflector, a window cutout in the wall of the downlight reflector and a resilient wall wash reflector attached to the reflector assembly such that it is positioned behind the window cutout. The resilient wall wash reflector has flexible sides which flex inward, allowing the reflector assembly to fit through the mounting frame opening during installation. Once the assembly has cleared the frame opening, the flexible sides return to their original shape. In an embodiment preferred for use as a comer or double (parallel) wall washer, the reflector assembly has a yoke assembly having a top plate and a leg extending between the top plate and the mounting frame. The yoke assembly may be installed through the mounting frame opening and secured to the mounting frame from below the ceiling. Wall wash reflectors may then be installed through the opening and attached to the yoke assembly. Lastly, a downlight reflector with window cutouts may be installed through the opening and attached to the yoke assembly such that the window cutouts are positioned in front of the wall wash reflectors.

25 Claims, 12 Drawing Sheets

RECESSED DOWNLIGHT WALL WASH REFLECTOR ASSEMBLY AND METHOD

BACKGROUND OF THE INVENTION

1. Field of the Invention

This invention relates to recessed light fixture reflector assemblies, and particularly to downlight wall wash reflector assemblies which are installable from below the plane of the ceiling and a method of installing such reflector assemblies.

2. Description of Prior Art

Recessed light fixtures are light fixtures which are recessed behind a planar surface, such as a ceiling, wall, or floor. The fixtures are designed such that light exits the fixture through a hole or opening in the planar surface. The fixtures are primarily used in ceilings. Since generally no components of the fixture hang down below the ceiling, use of the fixtures allows lighting designers to illuminate a workspace while maintaining a smooth ceiling line. Thus, illumination is provided while the source of the light is, in effect, concealed.

Since the light source is located completely above the ceiling, efficiency concerns require the light from the source to be collected and focused downward and outward through the opening. Typically, this is accomplished through the use of a reflector assembly located above and around the sides of the light source directing the light downward and outward. However, it is desirable to shield the light source, and reflections of the light source in the reflector assembly, from normal viewing angles in the room. Direct view of the light source, or even a reflection of the light source in the reflector assembly, will create glare and uncomfortable brightness to an observer in the room. Thus, it is generally desirable in a home or workplace environment that the light from a recessed downlight reflector be focused outward at low angles, i.e. approximately 50 degrees or less, as measured from the nadir of the fixture. This angular measurement has been determined to shield an observer looking across the room from glare, while allowing each fixture to illuminate a reasonably sized area.

Utilizing today's commonly available light sources, including incandescent, fluorescent, low voltage, metal halide, and high intensity discharge (HID), recessed downlight reflectors are generally conical in shape, have round light exit apertures, and produce a generally conical shaped area of illumination. Thus, the illumination of the room can be accomplished by the arrangement of multiple recessed downlight fixtures such that their output light patterns produce the desired result.

The placement of a recessed downlight fixture in proximity to a wall or other vertical surface thus produces a scalloped illumination pattern as the vertical surface intersects the cone of light produced by the downlight reflector. This scalloped illumination effect is often undesirable and occasionally unacceptable. Thus, lighting designers often desire for recessed fixtures located close to walls to project light at both high and low angles toward the walls to evenly illuminate them from the ceiling to the floor, in effect washing the walls with light. However, it is desirable that light directed toward the room from such fixtures remain directed at lower angles to prevent glare. This requires the use of two different reflector designs in the same fixture: 1) the downlight reflector design discussed earlier to direct room side light downward and outward at low angles; and 2) a wall wash reflector to direct light primarily outward to illuminate the wall from the ceiling to the floor. Thus, a recessed downlight wall wash reflector combines both downlight and wall wash reflectors.

Additionally, it is desired that the ceiling opening and the appearance of the downlight wall wash fixture match the appearance of downlight only fixtures located elsewhere in the room.

Further complicating matters, it is often desirable or necessary to be able to install the recessed downlight wall wash reflector assemblies from below the ceiling. For instance, with the advent of new, more efficient compact fluorescent light sources many users wish to replace their older, less efficient incandescent recessed fixtures. However, access to the area above the ceiling is often unavailable with permanent type ceiling construction. Thus, the new reflector assembly must be installable, i.e. able to fit, into the old ceiling opening and frame that was used for the incandescent fixture.

A problem that has arisen, is that efficient wall wash reflector designs cause the downlight/wall washer reflector assembly to have a maximum width larger than the ceiling opening or mounting frame will accommodate.

Further, it is sometimes desirable to equip recessed fixtures having vertical surfaces on more than one side, such as hallways and comers, with wall wash reflectors to wash each vertical surface. The desired result can be achieved by outfitting the fixtures with multiple wall wash reflectors in either a double (parallel) configuration for a hallway, or a perpendicular configuration for a comer. However, this farther complicates matters by increasing the maximum diameter of the reflector assembly to an even greater dimension.

Typically, the increased diameter of wall wash reflector assemblies require special dedicated mounting frames and must be installed through access to the area above the ceiling.

Additionally, and especially with recessed fixtures configured for parallel and comer wall washing, it is desirable that the downlight and wall wash reflector assemblies have adjustable optics so that their illumination patterns may be aimed at the installation site.

SUMMARY OF THE INVENTION

Thus, it is an object of the present invention to provide an improved downlight wall wash reflector assembly installable from below a ceiling into a standard mounting frame for a recessed downlight reflector having a matching light exit aperture size.

It is another object of the present invention to provide a recessed downlight wall wash reflector assembly having a downlight reflector with a special window cutout behind which a wall wash reflector is positioned to provide wall washing opposite the wall wash reflector and downlighting around the rest of the reflector.

It is another object of the present invention to provide an improved downlight wall wash reflector assembly having single, double and corner wall wash configurations.

It is another object of the present invention to provide an aimable downlight wall wash reflector assembly.

One embodiment of the recessed downlight wall wash reflector assembly of the present invention addresses the problems described by utilizing a resilient wall wash reflector capable of flexing to allow the maximum diameter of the downlight wall wash reflector to be reduced to fit through the ceiling/mounting frame opening.

Another embodiment of the recessed downlight wall wash reflector assembly of the present invention addresses the problems described by utilizing a yoke assembly which is installable through the ceiling and frame opening. Various configurations of downlight/wall wash reflector assemblies can then be installed piece by piece through the ceiling/frame opening and attached to the yoke assembly. Once installed, the components of the reflector assembly can then be rotated in order to aim or adjust the illumination output of the recessed fixture toward the wall, as necessary.

DETAILED DESCRIPTION OF THE PREFERRED EMBODIMENT

The objects of the present invention may be accomplished in several embodiments. The preferred embodiment will be determined by the configuration, either single, double or corner wall washer, of the reflector assembly to achieve the desired results.

Figure 1:
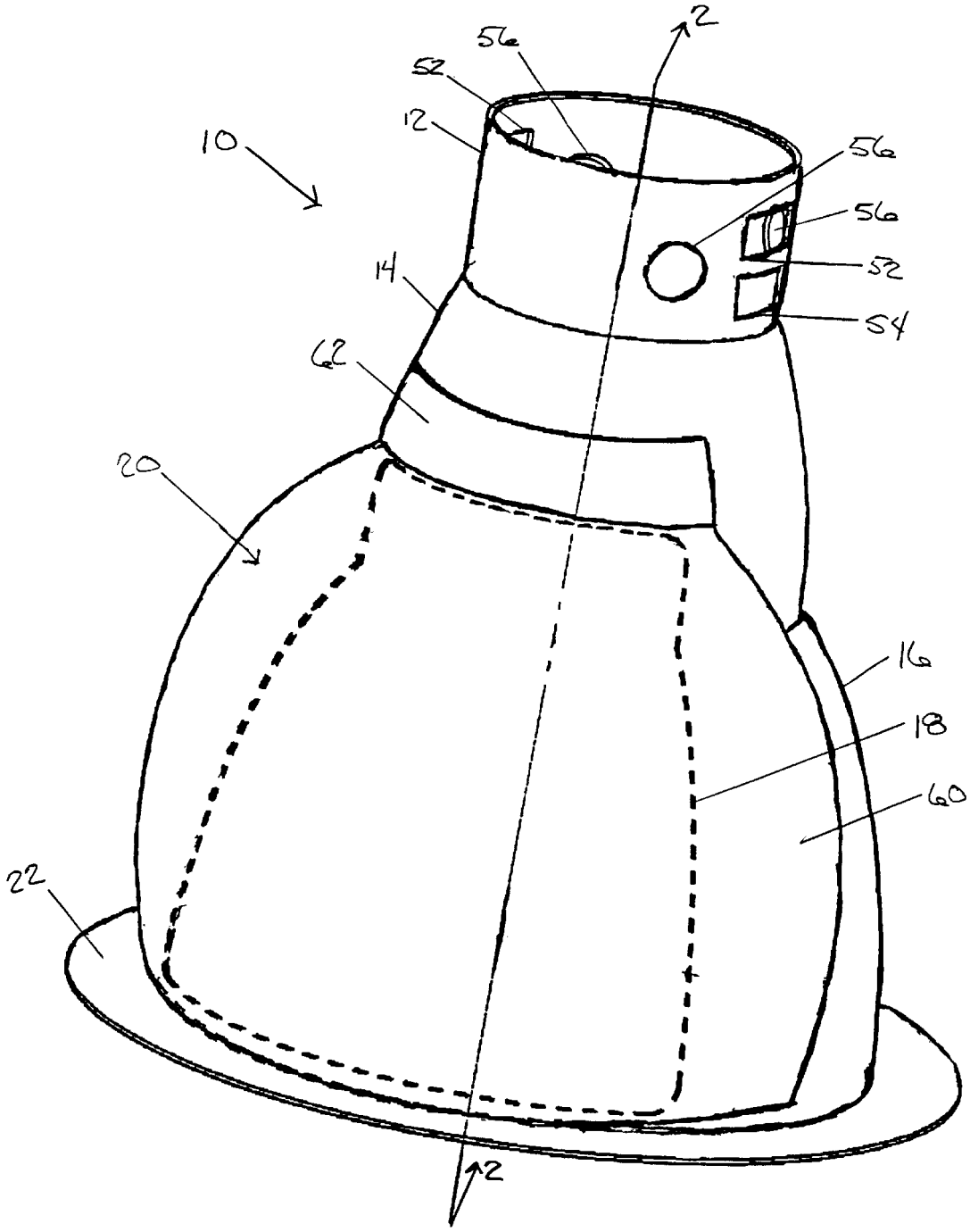
FIG. 1 is a perspective view of one embodiment of a recessed downlight single wall wash reflector assembly of the present invention. A window cutout underlying the wall wash reflector is shown in phantom lines.
Figure 2:
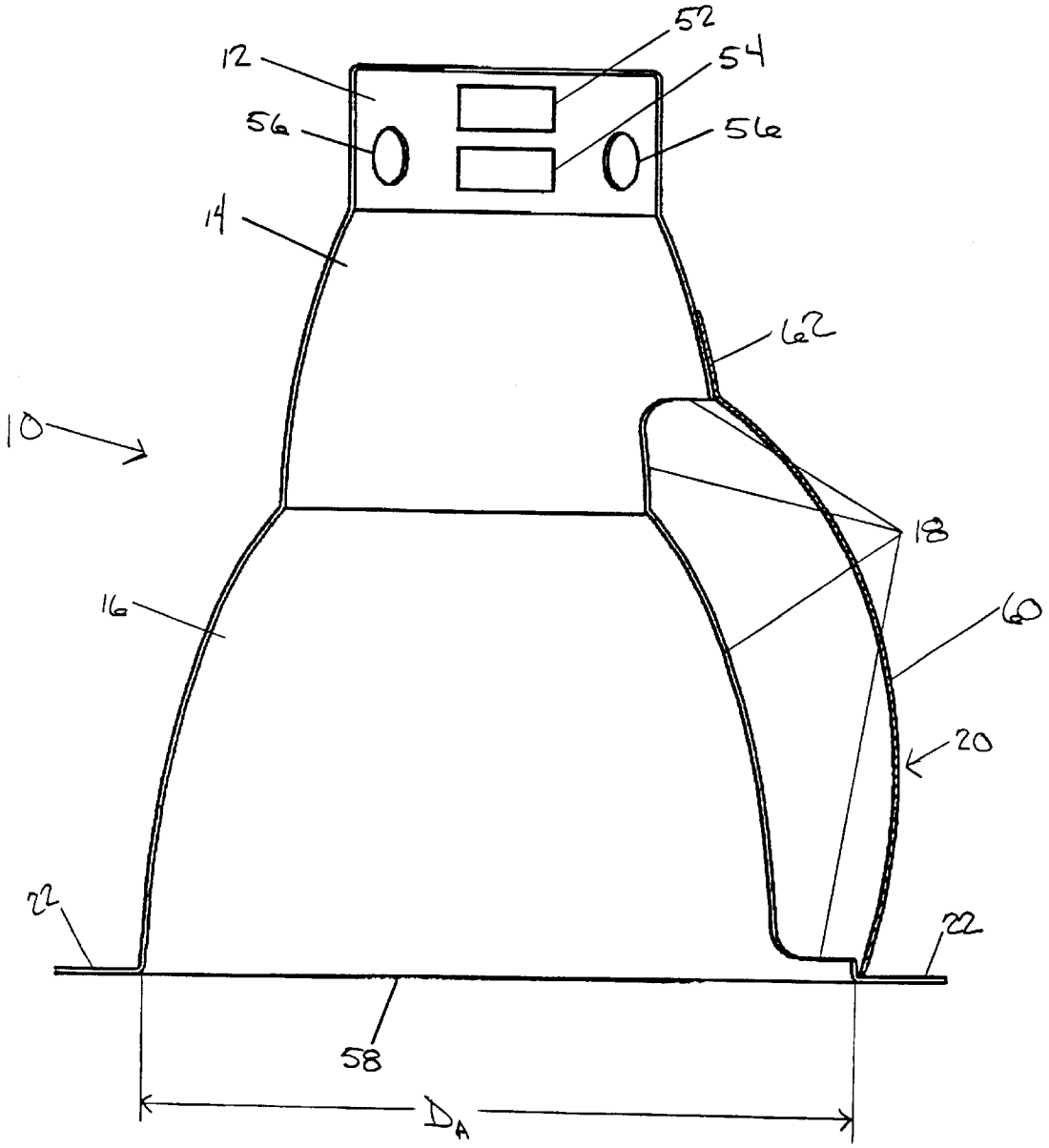
FIG. 2 is a sectional view taken along line 2—2 of FIG. 1.

A recessed downlight wall wash reflector assembly 10 configured for use as a single wall washer, as shown in FIGS. 1 and 2, designed for use with a compact fluorescent lamp light source, has a socket cup receiving neck 12, a light source positioning section 14, a downlight reflector section 16, a window cutout 8, a wall wash reflector 20 and a trim flange 22. The assembly may be fabricated from aluminum or any other suitable material such that the reflector assembly 10 has the strength and rigidity to support a socket cup and lamp assembly, thus eliminating the need for a separate fixture housing.

Figure 3:
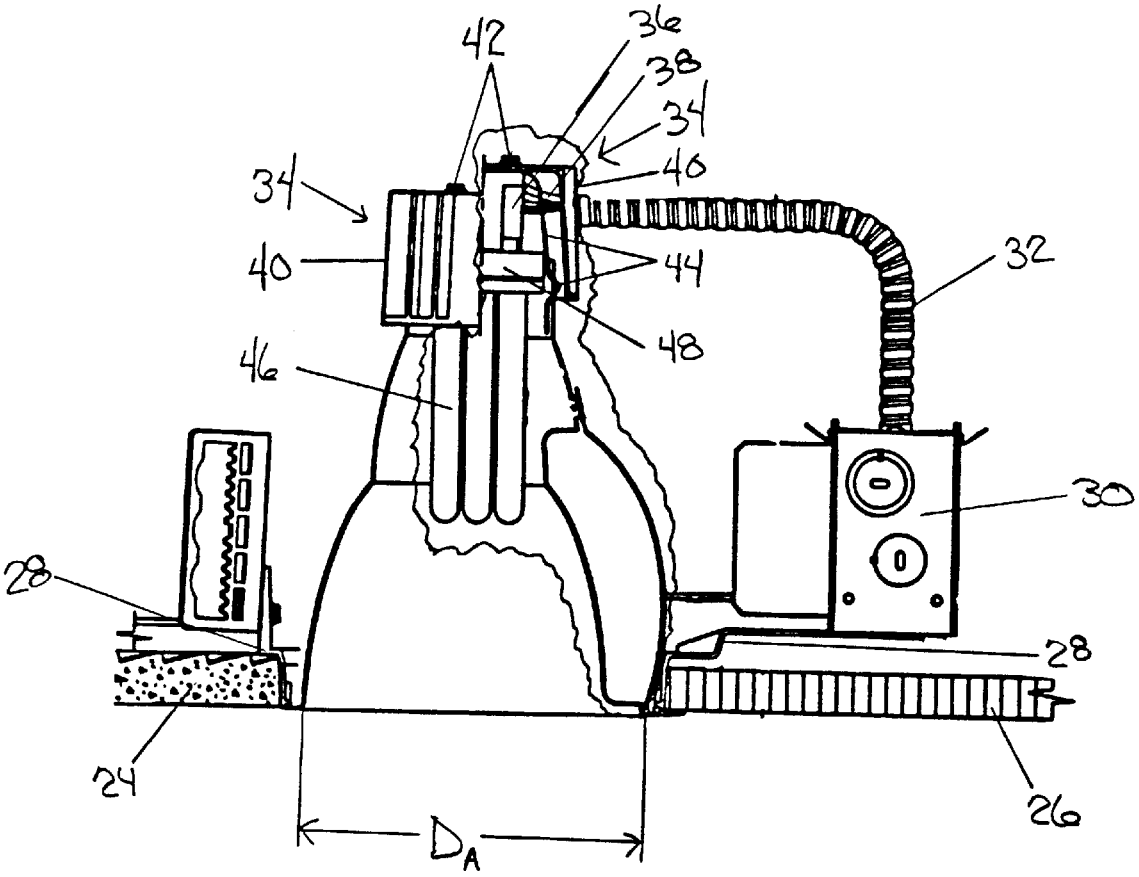
FIG. 3 is side view with selected portions cut-away of a fully installed recessed light fixture utilizing the assembly of FIG. 1.

FIG. 3 shows a fully installed recessed light fixture with a downlight wall wash reflector assembly of the present invention. For illustration, the figure shows installation of the fixture in both plaster/drywall 24 and acoustic tile 26 type ceilings. Additionally, the figure shows a standard mounting frame 28 for a recessed downlight reflector. Further shown are an electrical junction box 30 for attaching the wiring of the fixture to an external power source and armored cable 32 running from the junction box 30 to the socket cup assembly 34.

Figure 4:
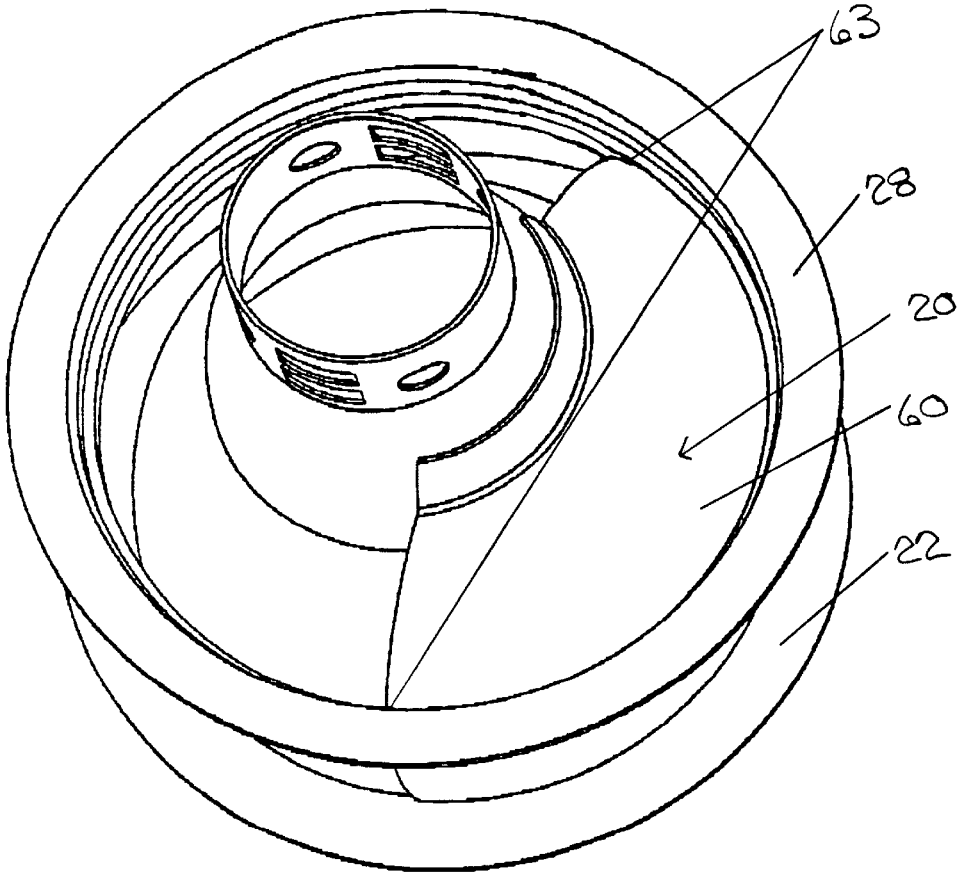
FIG. 4 is a perspective view of the downlight wall wash reflector assembly of FIG. 1 in the process of being installed into a mounting frame, showing impingement of the sides of the wall wash reflector against the mounting frame.

A partial cut-away view of the socket cup assembly 34 is shown in FIG. 4 where it connects with the armored cable 32. This cut away view shows the lamp socket 36 and wiring 38 running from the armored cable 32 to the lamp socket 36. The lamp socket 36 is attached to the socket cup 40 by screws 42. Also shown in the cut away view are a socket cup spring tab 44 and the fluorescent lamp 46 and lamp base 48.

The socket cup receiving neck 12 is designed to receive a standard socket cup assembly 34, as shown in FIG. 3, which are well known in the industry. To that end, the neck 12 is generally cylindrical and has socket cup spring tab receiving slots 52, 54. However, the neck 12 may be flattened slightly at the location of the socket cup spring tab receiving slots 52, 54 to better accommodate the socket cup spring tabs 44. The socket cup receiving neck 12 is open at the top to receive the lamp socket 36 and spring tabs 44 of the socket cup assembly 34. Additionally, the socket cup receiving neck 12 is open at the bottom to allow a lamp 46 held by the socket cup lamp socket 36 to extend downward into the reflector assembly 10.

The embodiment shown in FIGS. 1–5, is designed for use with either 26 watt or 32 watt triple tube type compact fluorescent lamps, such as are well known in the industry and manufactured by companies such as Phillips, Osram Sylvania, or General Electric. Since the 26 watt and 32 watt lamps differ in length, an upper slot 52 and a lower slot 54 are provided in the socket cup receiving neck 12 in order to position each lamp in proper alignment with the optics of the reflector assembly 10. The 32 watt lamp having a longer longitudinal length, by assembling the socket cup assembly 34 to the neck such that the spring tabs 44 mate with the upper spring tab receiving slots 52, the lamp will be properly positioned in the reflector assembly 10. Likewise, the 26 watt lamp will be properly positioned when the socket cup assembly 34 is assembled to the neck 12 such that the spring tabs 44 mate with the lower spring tab receiving slots 54.

Additionally shown in FIG. 2, socket cup receiving neck 12 has ventilation holes 56 spaced around its periphery to provide a path for some air flow around the lamp tube 46, allowing it to operate at a cooler and more efficient temperature.

The light source positioning section 14 is located below the socket cup receiving neck 12. This section is also open at the top and bottom. It is attached to the socket cup receiving neck 12 and downlight reflector section 16 at its top and bottom, respectively. The lamp tubes 46 extend through this section and slightly into the downlight reflector section 16. It has a slight tapering curve to its walls to transition from the diameter of the upper end of the downlight reflector section 16 to the lower end of the socket cup receiving neck 12 . The shape of the light source positioning section 14 is for ease of manufacture only and serves no other purpose. Likewise, the material of the light source positioning section 14 is an unfinished aluminum and, while it does encircle the lamp 46, it performs no optical work. The sole purpose of this section is to position the lamp in proper relation to the downlight and wall wash reflectors 16, 20 so that the desired effects of even illumination of a wall and glare free room side illumination are achieved.

The downlight reflector section 16 is located below the light source positioning section 14 and attached thereto around the light source positioning section's 14 lower edge. Actually, in the preferred embodiment, the downlight reflector section 16, light source positioning section 14, and socket cup receiving neck 12 have a unitary construction, but are described herein as sections according to their function. The downlight reflector section 16 is also open at its top and bottom. The downlight reflector section 16 is designed to deliver the maximum available light from the lamp 46 while shielding the lamp 46 from normal viewing angles to prevent uncomfortable brightness or glare to the viewer. It is usually made of aluminum and its interior, reflective surface is polished to a specular finish.

The bottom of the downlight reflector section 16 is open to the room below and is referred to as the light exit aperture 58. The diameter of the light exit aperture, $D_A$, for the downlight wall wash reflector assembly 10 is identical to the diameter of the light exit aperture of a companion downlight only fixture, so as to create a uniform appearance in a room having both types of fixtures.

Extending outward from the bottom end of the downlight reflector section 16 is an annular trim flange 22. The purpose of the trim flange 22 is to cover the rough appearance of the hole in the ceiling 24, 26 and to provide a smooth transition from the ceiling 24, 26 into the reflector assembly 10.

A window cutout 18 is made, as shown in FIGS. 1–3 to allow light from the lamp to be reflected off of the wall wash reflector 20, which is attached to the assembly such that it is positioned behind the window cutout 18. The window cutout extends from just slightly above the lower edge of the downlight reflector section 16 upward into the light source positioning section 14 about ⅓ of the distance between the light source positioning section 14 to the socket cup receiving neck 12. The angular width of the window cutout 18 is approximately 120 degrees.

The wall wash reflector 20 is comprised of a kick reflector 60 and a flange 62 formed at the upper end of the kick reflector 60. The kick reflector 60 is specifically designed, in conjunction with the herein described window cutout 18, to direct light from the lamp 46 to illuminate the adjacent wall evenly from the ceiling line to the floor. The flange 62 is shaped to match the contour of the light source positioning section 14. The wall wash reflector 20 is attached at its flange 62 to the light source positioning section 14 through the use of a toggle lock mechanism. Thus, the sides and bottom of the kick reflector 60 are unattached.

As shown in FIG. 4, the sides of the kick reflector 60 extend outward such that the sides impinge the mounting frame 28 during installation of the reflector assembly 10 into the mounting frame 28. Impingement points 63 are shown in FIG. 4.

Figure 5:
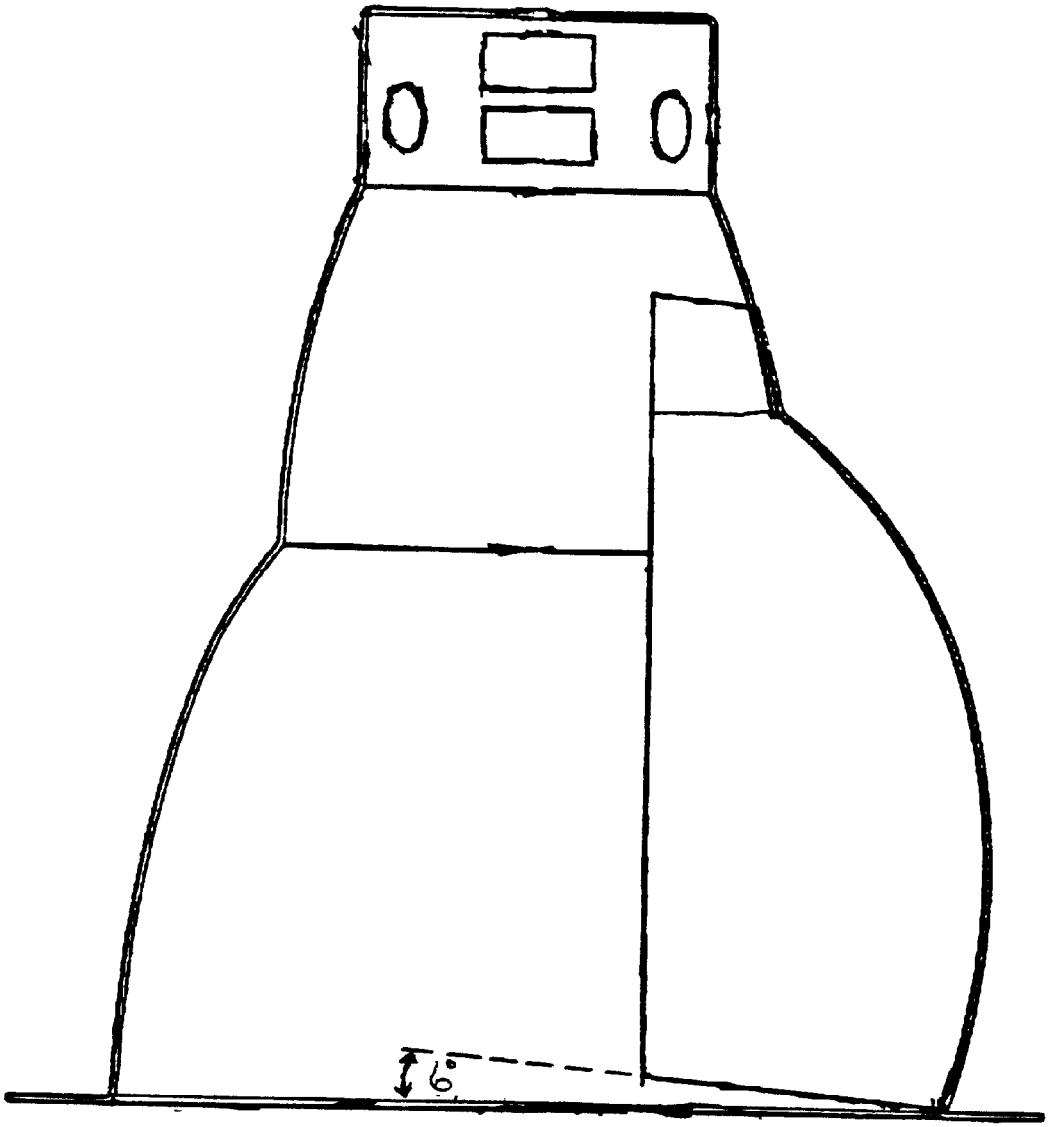
FIG. 5 is a side view of the assembly of FIG. 1 showing a cut along the bottom edge of a wall wash reflector to facilitate flexation of the reflector.

Also, as shown in FIG. 5, the bottom edge of the kick reflector 60 is cut at an angle of approximately 6 degrees from the midpoint of the bottom of the kick reflector 60, outward toward each side. This cut allows the kick reflector 60, also usually fabricated of aluminum, to have a resilient quality such that the sides may flex inward slightly while the reflector assembly 10 is being installed from below the ceiling, and return to their original orientation once the kick reflector 60 has cleared the mounting frame 28 opening.

Figure 4A:
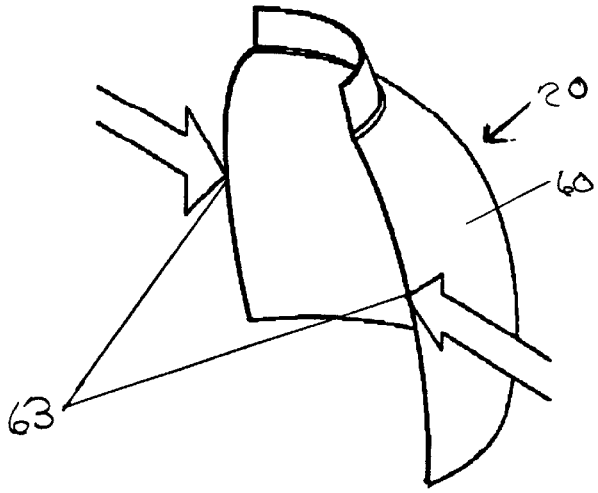
FIG. 4*a* is a perspective view of the wall wash reflector of FIG. 4 showing the forces acting at the impingement points of the wall wash reflector with the mounting frame.

FIG. 4*a* shows the forces acting on the wall wash reflector 20 at the impingement points 63 of the wall wash reflector with the mounting frame which result in flexation of the resilient kick reflector 60 to allow it to fit through the mounting frame 28 opening.

Figure 6:
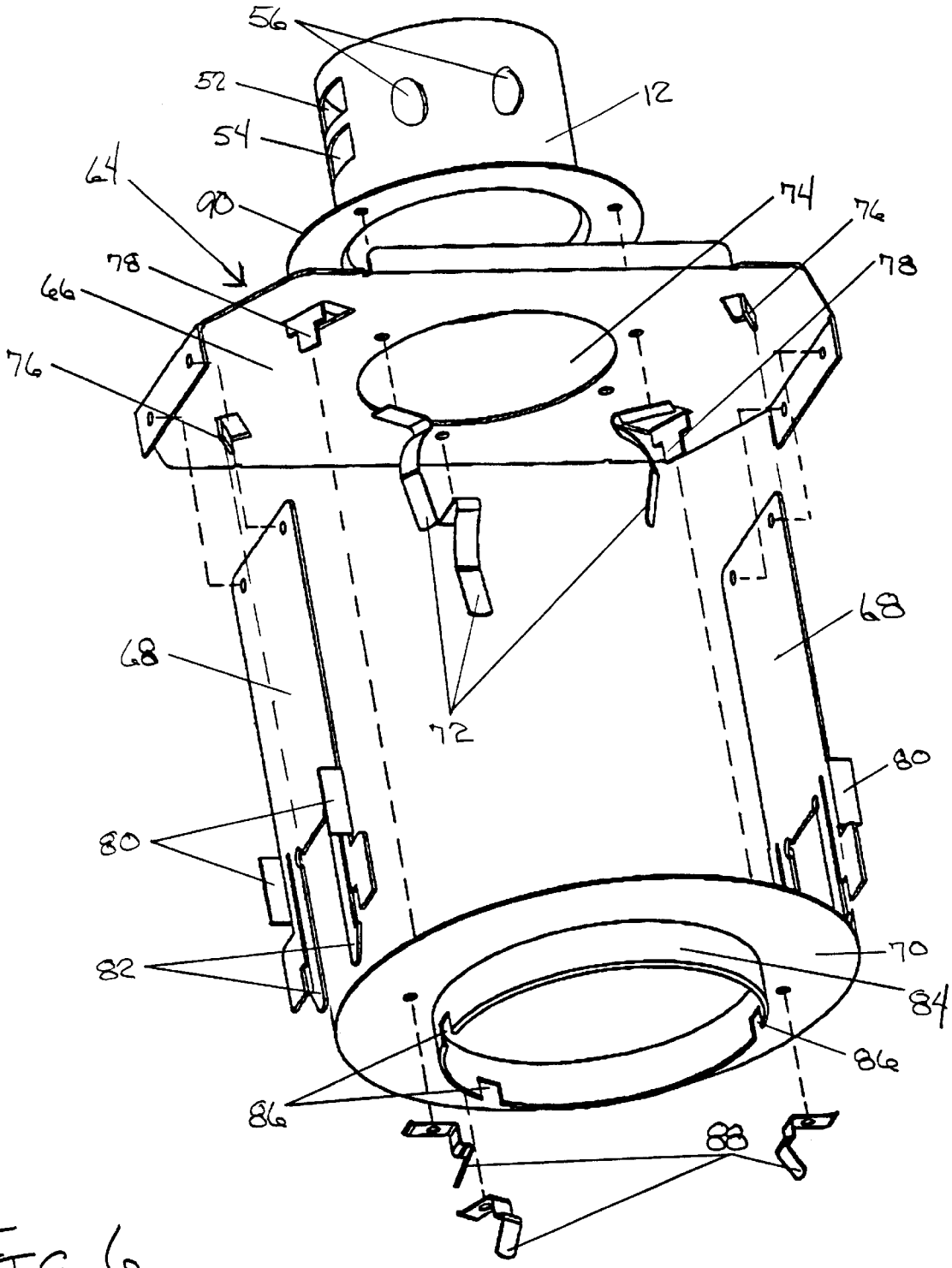
FIG. 6 is an exploded view of a yoke assembly of a second embodiment of a recessed downlight wall wash reflector assembly of the present invention.
Figure 7A:
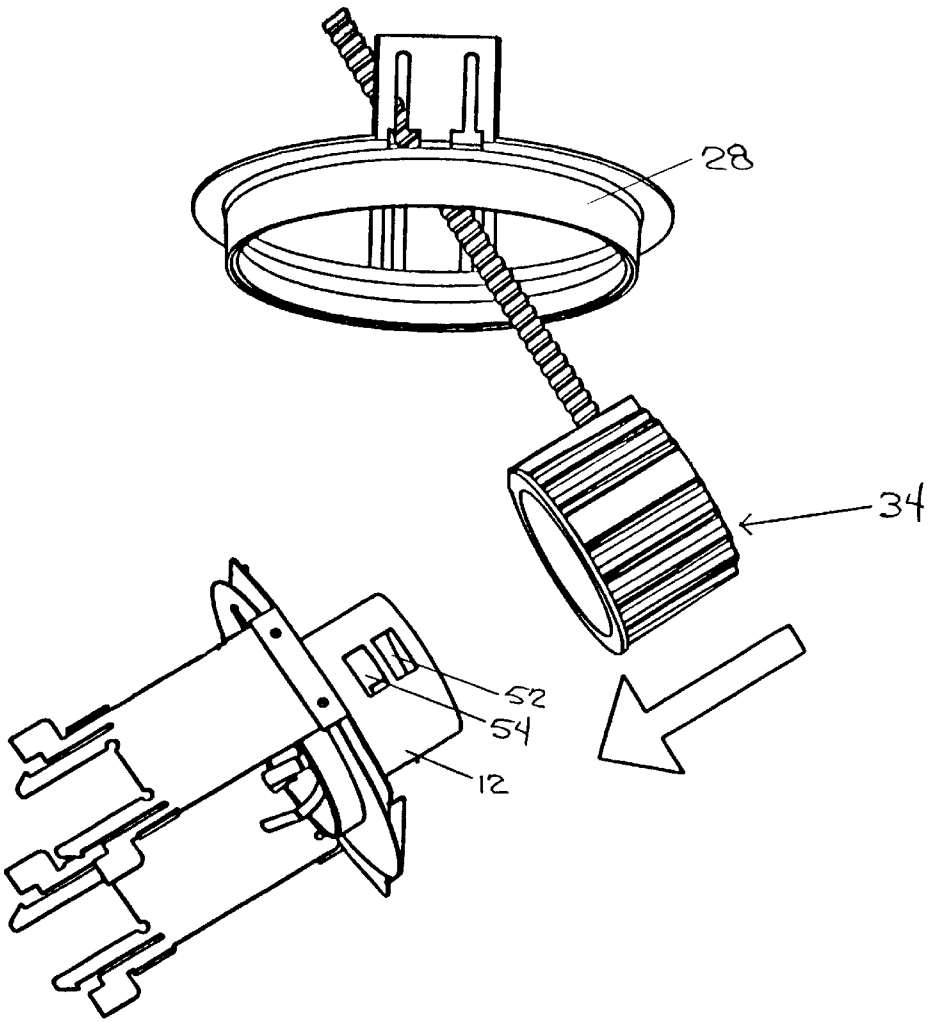
FIG. 7A is an illustration of the step of attaching a socket cup assembly to the yoke assembly of FIG. 6 for installation into a mounting frame (also shown).
Figure 7B:
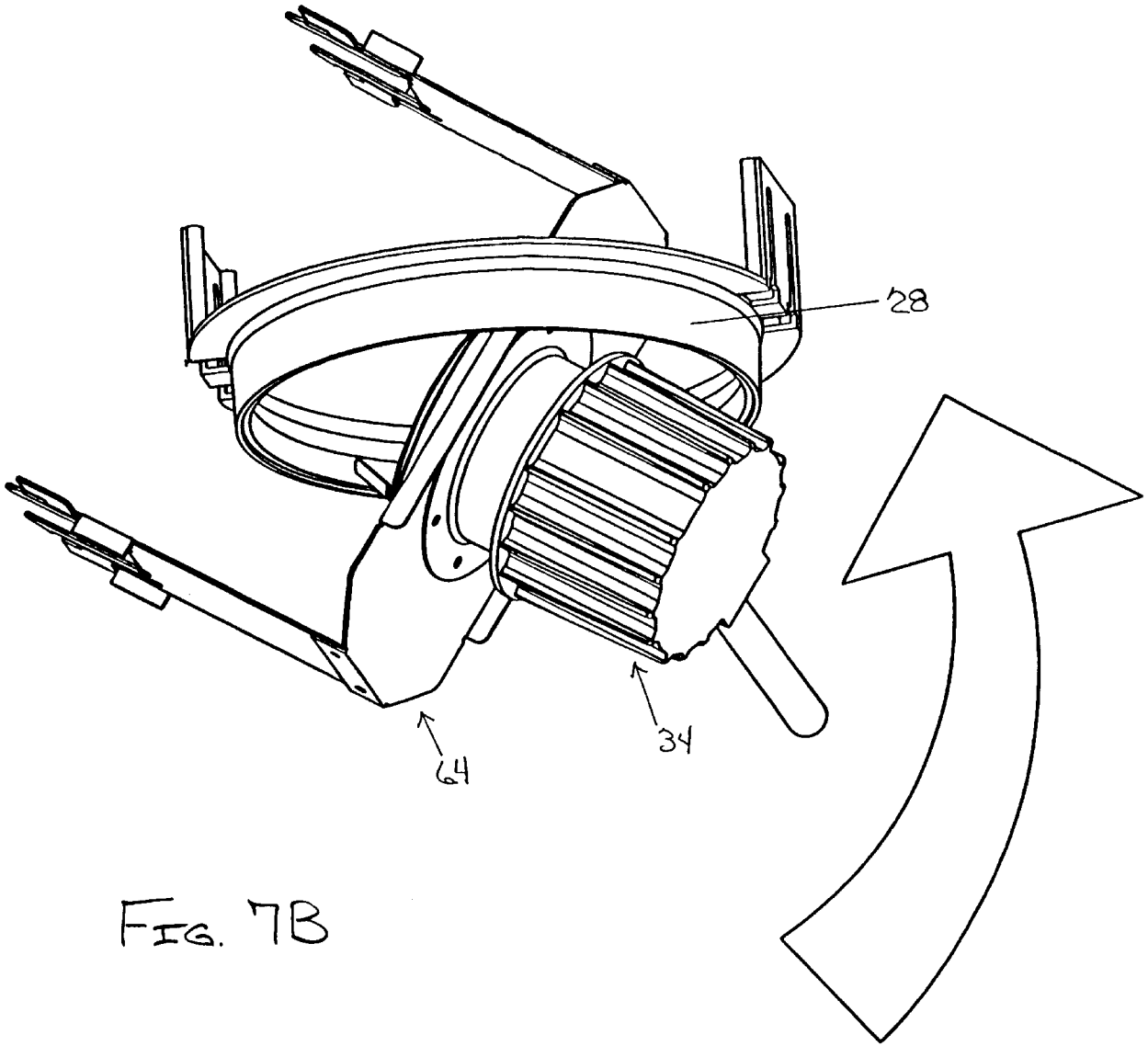
FIG. 7B is an illustration of the step of inserting the yoke assembly and socket cup assembly of FIG. 7A through the mounting frame aperture.
Figure 7C:
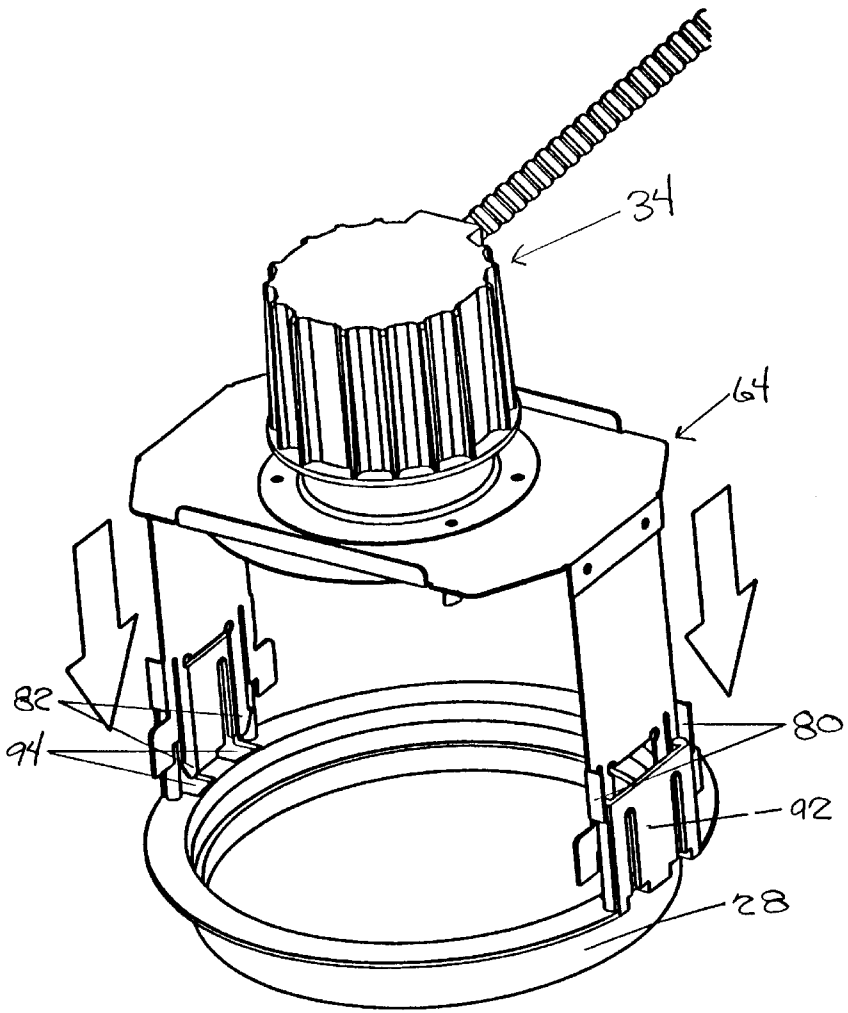
FIG. 7C is an illustration of the step of securing the yoke and socket cup assemblies of FIG. 7A to the mounting frame.
Figure 7D:
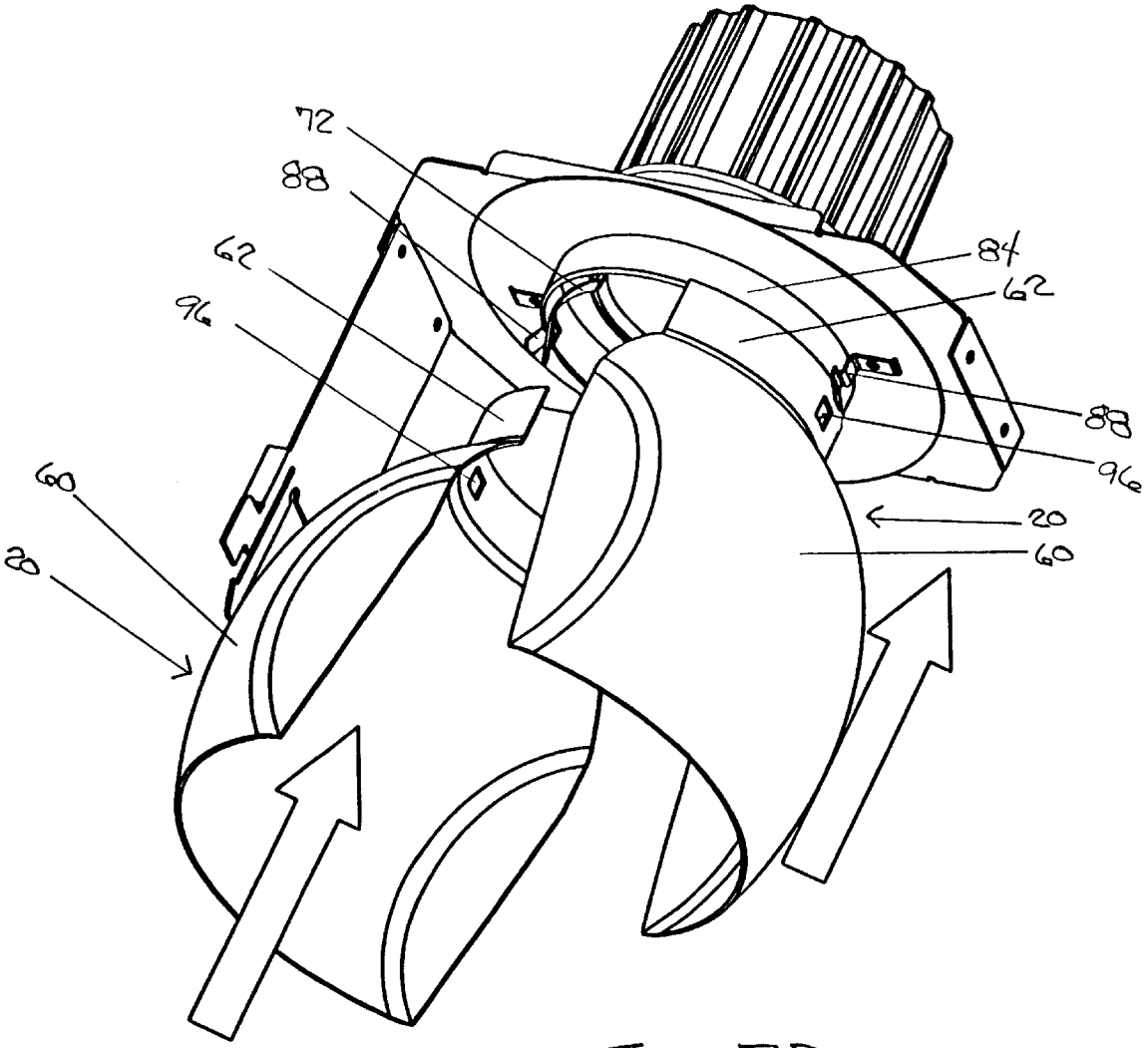
FIG. 7D is an illustration of the step of securing kick reflectors in a double wall wash configuration to the yoke and socket cup assemblies of FIG. 7A. For clarity, a leg of the yoke assembly and the mounting frame have been removed from the Figure.
Figure 7E:
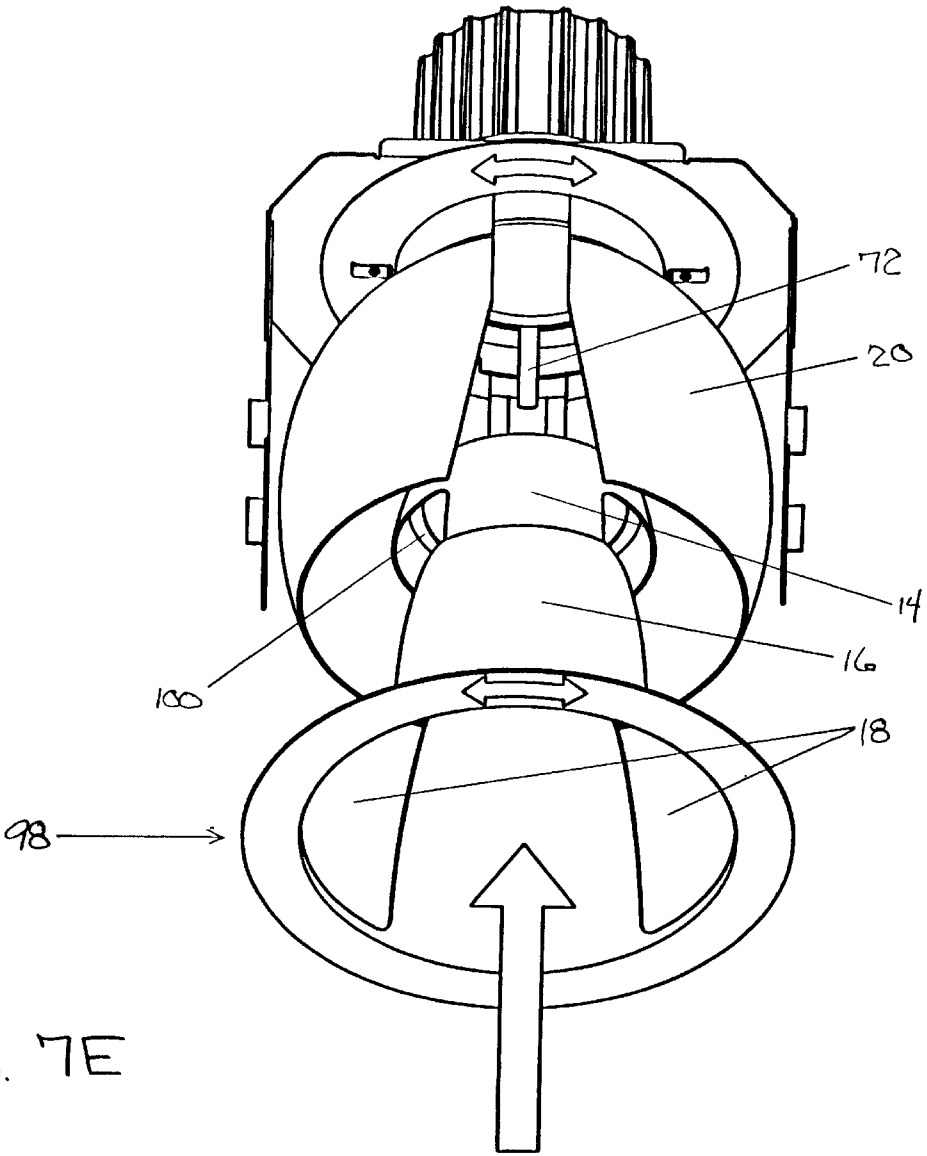
FIG. 7E is an illustration of the step of securing a downlight reflector with double wall wash window cutouts to the yoke and socket cup assemblies and the wall wash reflectors of FIG. 7D. For clarity, the legs of the yoke assembly and the mounting frame have been removed from the Figure. Rotation directions of the reflector components are also illustrated in this Figure.
Figure 7F:
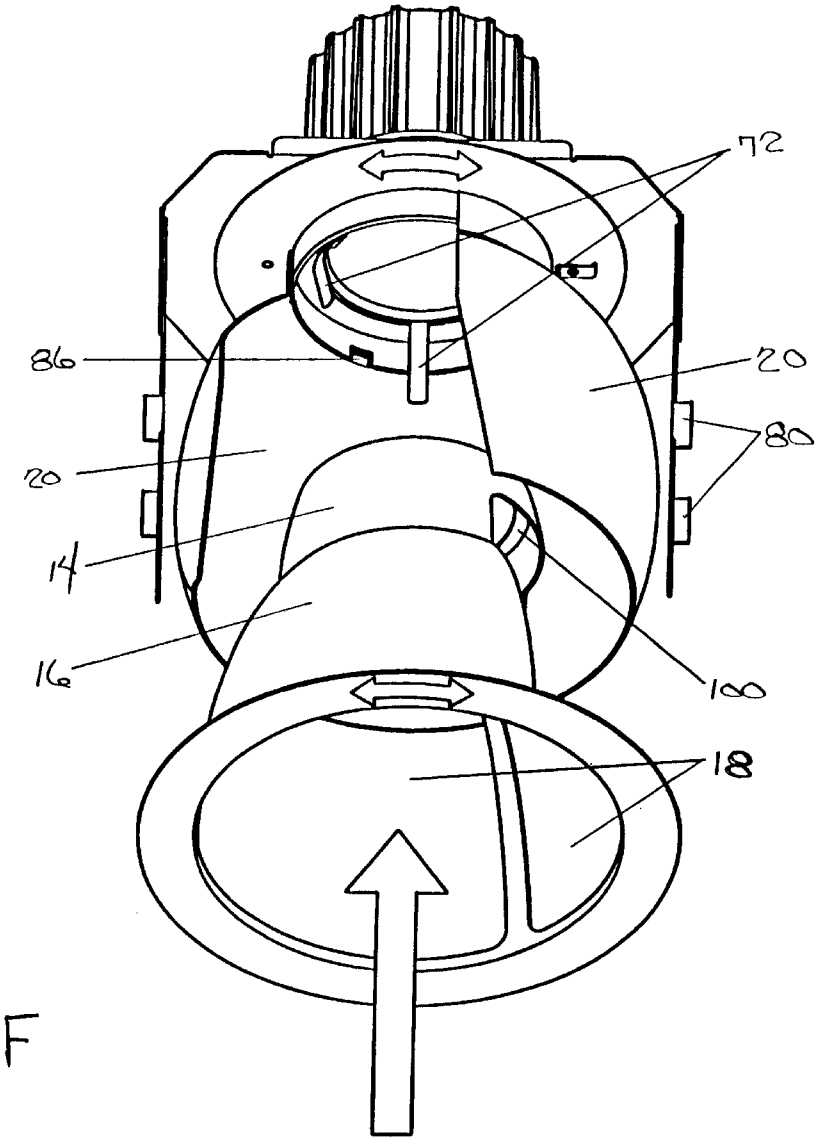
FIG. 7F is an illustration of the step of securing a downlight reflector with corner wall wash window cutouts to a yoke and socket cup assembly having comer wall wash reflector components according to the present invention. Rotation directions of the reflector component are also illustrated in this Figure.

Another embodiment of a recessed downlight wall wash reflector assembly designed for use in either single, double, or comer wall washer configurations is shown in FIGS. 6–7F. While this embodiment can function in all three configurations, it is the preferred embodiment for double and comer wall washer configurations. The socket cup receiving neck 12, light source positioning section 14, downlight reflector section 16, window cutout 18, wall wash reflector 20 and trim flange 22 taught in the previously described embodiment are all present and function similarly in this embodiment. However, their interconnection and method of installation differ as discussed below.

As shown in FIGS. 7A through 7F, one key element to this embodiment is the use of a yoke assembly 64 which allows the reflector assembly 10 components to be inserted piece by piece from below the ceiling. The yoke assembly 64, in conjunction with the steps described below, facilitates installation of the downlight wall wash reflector assembly 10 from below the ceiling into position in the ceiling opening and mounting frame 28.

The yoke assembly 64, as shown in FIG. 6, has a top plate 66, legs 68, a wall wash reflector receiving ring 70, and downlight reflector retaining springs 72.

The top plate 66 has a central light source opening 74, two vertical centering tabs 76 and two vertical trapping tabs 78 spaced around the perimeter of the central light source opening 74.

The legs 68 are attached to the edges of the top plate 66 and have guide tabs 80 and latching prongs 82 located at the ends distal to the top plate 66.

Wall wash reflector receiving ring 70 is rotatably attached to the top plate 66 by the bending of the end portion of the two trapping tabs 78 parallel to the top plate 66. The centering tabs 76 serve to keep the wall wash reflector receiving ring 70 properly centered as it rotates. Wall wash reflector receiving ring 70 also has an-annular flange 84 extending downward from its inner periphery. The flange 84 has three spring receiving slots 86 located for double and corner wall wash reflector configurations. Wall wash reflector retaining springs 88 are positioned around the ring 70 in alignment with the spring receiving slots 96 (See FIG. 7D).

As illustrated in FIG. 7 the socket cup assembly 34, which will be properly wired to the junction box (not shown) is pulled down through the ceiling (not shown) and frame 28 opening. Then, the socket cup assembly 34 is attached to the socket cup receiving neck 12. As this embodiment is also designed for use with compact fluorescent triple tube lamps (not shown) in either 26 watt or 32 watt sizes, the appropriate set of spring tab receiving slots 52, 54 in the socket cup receiving neck 12 will be utilized in conjunction with the socket cup spring tabs 44 to properly position and align the lamp with respect to the reflector assembly 10 optics.

As illustrated in FIG. 7B once the socket cup assembly 34 is properly attached to the yoke assembly 64, the yoke/socket cup assemblies may be inserted through the ceiling and frame 28 opening by inserting one leg 68 through the opening and rotating the combined assembly inward and upward until the entire combined assembly is above the plane of the ceiling.

The next step, as illustrated in FIG. 7C, is to secure the yoke assembly 64 to the mounting frame 28. This is accomplished by sliding the yoke assembly legs 68 downward along the mounting frame arms 92 such that the leg latching prongs 82 are pushed inward as they slide 20 through mounting frame prong receiving holes 94, spring outward once through the holes 94 and positively engage the mounting frame 28. This process is aided by the leg guide tabs 80 which align the legs 68 along the mounting frame arms 92 as the yoke assembly 64 is slid downward. The guide tabs 80 further serve to secure the legs 68 to the mounting frame 28 by bracing the yoke assembly 64 against the mounting frame arms 92 once the latching prongs 82 have engaged the mounting frame 78.

The wall wash reflectors 20, as shown in FIG. 7D, have a kick reflector 60 and a flange 62 along the upper edge of the kick reflector 60. The flange 62 has a retaining spring receiving slot 96. The flange 62 is shaped to match the downwardly extending flange 84 of the wall wash reflector receiving ring 70.

The next step, as illustrated in FIG. 7D, is to secure wall wash reflectors 20 to the wall wash reflector receiving ring 70 by sliding the reflectors 20 upward such that the inner surface of the wall wash reflector flange 62 is positioned against the outer surface of the wall wash reflector receiving ring flange 84 and the wall wash reflector retaining spring 88 engages the retaining spring receiving slots of both the wall wash reflector flange and the wall wash reflector receiving ring flange 62, 84. FIG. 7D illustrates the installation of wall wash reflectors 20 in a double (parallel) configuration.

A downlight reflector assembly 98 with appropriate window cutouts 18 for a double configuration is shown in FIG. 7E. The downlight reflector has light source positioning section 14 and downlight reflector sections 16. An inwardly directed annular rim 100 is located around the top edge of the light source positioning section 14. As the downlight reflector assembly 98 is pushed upward into the yoke assembly 64, the downlight reflector retaining springs 72 engage the inwardly directed annular rim 100 and light source positioning section 14 inner wall, holding the downlight reflector assembly 98 in position. The wall wash reflectors 20 and downlight reflector assemblies 98 can then be rotated with respect to the yoke assembly 64 for aiming or adjustment of the corresponding illumination produced by the recessed downlight wall wash reflector assembly 10.

FIG. 7F illustrates the step of installing a downlight reflector assembly 98 into recessed downlight wall wash reflector assembly 10 configured as a corner wall washer.

This detailed description is given primarily for clearness of understanding and no unnecessary limitations are to be understood therefrom, for modifications will become obvious to those skilled in the art upon reading this disclosure and may be made without departing from the spirit of the present invention and scope of the appended claims.

What is claimed is:

1. A recessed downlight wall wash reflector assembly installable from below a ceiling into a standard mounting frame for a recessed downlight reflector having a similarly sized light exit aperture comprising:

a downlight reflector;

a window cutout in a wall of the downlight reflector;

a resilient wall wash reflector positioned behind said window cutout and attached to said reflector assembly; and a socket cup receiving neck positioned above said downlight reflector, the socket cup receiving neck having at least one ventilation hole, the socket cup receiving neck having at least one socket cup tab receiving slot.

2. The recessed downlight wall wash reflector assembly of claim 1, the resilient wall wash reflector having sides which are sufficiently inwardly flexible that the width of the assembly may be reduced to fit through a mounting frame opening.

3. The recessed downlight wall wash reflector assembly of claim 1, the socket cup receiving neck being substantially cylindrical.

4. The recessed downlight wall wash reflector assembly of claim 1, the socket cup receiving neck being substantially cylindrical and having upper and lower socket cup tab receiving slots.

5. A recessed downlight wall wash reflector assembly installable from below a ceiling into a standard mounting frame for a recessed downlight reflector having a similarly sized light exit aperture comprising:

a downlight reflector;

a window cutout in a wall of the downlight reflector;

a resilient wall wash reflector positioned behind said window cutout and attached to said reflector assembly; and a light source positioning section between said downlight reflector and said socket cup receiving neck, said window cutout extending into the light source positioning section.

6. A recessed downlight wall wash reflector assembly installable from below a ceiling into a standard mounting frame for a recessed downlight reflector having a similarly sized light exit aperture comprising:

a downlight reflector;

a window cutout in a wall of the downlight reflector;

a resilient wall wash reflector positioned behind said window cutout and attached to said reflector assembly; and a bottom edge of said resilient wall wash reflector cut at an angle of approximately 6 degrees from the midpoint of the bottom of a kick reflector outward toward each side.

7. A recessed downlight wall wash reflector assembly installable from below a ceiling into a mounting frame for a standard recessed downlight reflector having a similarly sized light exit aperture, said reflector assembly comprising:

a yoke assembly comprising:

a top plate; and at least one leg attached to and extending between said top plate and said mounting frame;

a downlight reflector attached to said yoke assembly, said downlight reflector having a first window cutout; and a first wall wash reflector attached to said yoke assembly such that said first wall wash reflector is positioned behind said window cutout.

8. The recessed downlight wall wash reflector assembly of claim 7 further comprising a socket cup receiving neck positioned above said yoke assembly.

9. The recessed downlight wall wash reflector assembly of claim 8, the socket cup receiving neck being substantially cylindrical.

10. The recessed downlight wall wash reflector assembly of claim 8, the socket cup receiving neck having at least one ventilation hole.

11. The recessed downlight wall wash reflector assembly of claim 8, the socket cup receiving neck having at least one socket cup tab receiving slot.

12. The recessed downlight wall wash reflector assembly of claim 11, the socket cup receiving neck being substantially cylindrical has upper and lower socket cup tab receiving slots.

13. The recessed downlight wall wash reflector assembly of claim 8 further comprising a light source positioning section between said downlight reflector and said yoke assembly.

14. The recessed downlight wall wash reflector assembly of claim 13, said window cutout extending into the light source positioning section.

15. The recessed downlight wall wash reflector assembly of claim 7 further comprising a second window cutout in the wall of the downlight reflector and a second wall wash reflector attached to said yoke assembly such that it is positioned behind said second window cutout.

16. The recessed downlight wall wash reflector assembly of claim 13 further comprising a second window cutout which extends into said light source positioning section and a second wall wash reflector attached to said yoke assembly such that it is positioned behind said second window cutout.

17. The recessed downlight wall wash reflector assembly of claim 7, said downlight reflector being rotatably attached to said yoke assembly.

18. The recessed downlight wall wash reflector assembly of claim 17 having a plurality of downlight reflector retaining springs attached to the lower side of said top plate, said downlight reflector retaining springs providing rotatable attachment of said downlight reflector to said yoke assembly.

19. The recessed downlight wall wash reflector assembly of claim 13, said light source positioning section being rotatably attached to said yoke assembly.

20. The recessed downlight wall wash reflector assembly of claim 19 having a plurality of downlight reflector retaining springs attached to the lower side of said top plate, said downlight reflector retaining springs providing rotatable attachment of said downlight reflector to said yoke assembly.

21. The recessed downlight wall wash reflector assembly of claim 7 further comprising an annular ring rotatably connected to the lower side of said top plate, said annular ring having:

a first wall wash reflector retaining spring; and a downward flange having a first retaining spring receiving slot aligned with said first wall wash reflector retaining spring;

said first wall wash reflector having a kick reflector and a flange along the upper edge of the kick reflector, said kick reflector flange having a spring receiving slot;

said first wall wash reflector being attached to said annular ring by said first wall wash reflector retaining spring in cooperation with said first wall wash reflector flange spring receiving slot and said annular ring flange first retaining spring receiving slot.

22. The recessed downlight wall wash reflector assembly of claim 21 further comprising a second wall wash reflector also having a kick reflector and a flange along the upper edge of the kick reflector, said flange having a spring receiving slot, and said annular ring further comprising:

a second wall wash reflector retaining spring; and a second retaining spring receiving slot in said downward flange, said second spring retaining spring receiving slot aligned with said second wall wash reflector retaining spring;

said second wall wash reflector being attached to said annular ring by said second wall wash reflector retaining spring in cooperation with said second wall wash reflector flange spring receiving slot and said annular ring flange second retaining spring receiving slot.

23. The recessed downlight wall wash reflector assembly of claim 21, said top plate further comprising:

a central light source opening;

trapping tabs spaced around the perimeter of the central light source opening;

said trapping tabs providing rotatable attachment of said annular ring to said top plate.

24. The recessed downlight wall wash reflector assembly of claim 23, said top plate further comprising centering tabs spaced around the perimeter of the central light source opening.

25. A method of installing a recessed downlight wall washer reflector assembly from below a ceiling into a mounting frame opening for a recessed downlight reflector having a similarly sized light exit aperture comprising:

attaching a socket cup assembly to a socket cup receiving neck attached to a yoke assembly;

inserting the yoke assembly through the mounting frame opening;

securing the yoke assembly to the mounting frame;

inserting a wall wash reflector through the mounting frame opening;

securing the wall wash reflector to the yoke assembly;

inserting a downlight reflector having a window cutout through the mounting frame opening; and securing the downlight reflector to the yoke assembly such that said wall wash reflector is positioned behind said window cutout.

* * * * *

UNITED STATES PATENT AND TRADEMARK OFFICE

CERTIFICATE OF CORRECTION

PATENT NO. : 6,350,047 B1 
DATED : February 26, 2002
INVENTOR(S) : Sherman Ng, Wayne Rogers and Brian Roberge It is certified that error appears in the above-identified patent and that said Letters Patent is hereby corrected as shown below:

Title page,
Item [57], ABSTRACT,
Line 15, change “comer” to -- corner --

Column 2,
Line 13, after “fit”, delete the comma “,”
Line 23, change “comer” to -- corner --
Line 27, change “comer” to -- corner --
Line 28, change “farther” to -- further --
Line 36, change “comer” to -- corner --

Column 3,
Line 16, after “is”, insert -- a --

Column 4,
Line 8, change “8” to -- 18 --

Column 6,
Line 17, change “comer” to -- corner --
Line 20, change “comer” to -- corner --
Line 57, insert missing paragraphs (2) as follows:
-- Three downlight reflector retaining springs 88 are attached to the underside of the top plate 66 around the central light source opening 74 and interior to the wall wash reflector receiving ring flange 84.

Socket cup receiving neck 12 is attached to the upper side of the top plate 66 and has upper and lower slots 52, 54, and ventilation holes 56. The socket cup receiving neck 12 also has a flange 90 around its lower perimeter to facilitate its attachment to the top plate 66. --

UNITED STATES PATENT AND TRADEMARK OFFICE

CERTIFICATE OF CORRECTION

PATENT NO. : 6,350,047 B1 
DATED : February 26, 2002
INVENTOR(S) : Sherman Ng, Wayne Rogers and Brian Roberge It is certified that error appears in the above-identified patent and that said Letters Patent is hereby corrected as shown below:

Column 7,
Line 12, after "slide," delete "20".

Signed and Sealed this

Seventeenth Day of September, 2002

*Attest:*

*Attesting Officer*

JAMES E. ROGAN
*Director of the United States Patent and Trademark Office*